US006739274B2

(12) United States Patent
Eagles et al.

(10) Patent No.: US 6,739,274 B2
(45) Date of Patent: May 25, 2004

(54) END PORTIONS FOR A FLEXIBLE FLUID CONTAINMENT VESSEL AND A METHOD OF MAKING THE SAME

(75) Inventors: Dana Eagles, Sherborn, MA (US); Roland E. Jordan, North Attleboro, MA (US); Jonathan S. Barish, South Easton, MA (US); John J. Farrell, Norwood, MA (US); Glenn Kornett, Bonneau, SC (US); Stoney Thornley, Charleston, SC (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/921,617

(22) Filed: Aug. 3, 2001

(65) Prior Publication Data

US 2002/0148401 A1 Oct. 17, 2002

Related U.S. Application Data

(63) Continuation-in-part of application No. 09/908,877, filed on Jul. 18, 2001, which is a continuation-in-part of application No. 09/832,739, filed on Apr. 11, 2001.

(51) Int. Cl.[7] ..... B63B 25/08; B65D 88/78; B65D 33/16

(52) U.S. Cl. ..... 114/74 T; 114/256; 383/70; 383/71

(58) Field of Search ..... 714/74 T, 256; 138/89, 91, 93, 118; 383/42, 70, 78, 82, 83, 88, 89, 98, 109, 123, 125, 59, 60, 71; 405/15; 24/30.5 R, 30.5 W; 220/560

(56) References Cited

U.S. PATENT DOCUMENTS

| | | | | | |
|---|---|---|---|---|---|
| 34,426 | A | | 2/1862 | Howard | |
| 389,615 | A | | 9/1888 | Townsend | |
| 1,723,307 | A | | 8/1929 | Sipe | |
| 1,921,015 | A | | 8/1933 | Young | |
| 2,009,511 | A | * | 7/1935 | Nydegger | 383/70 |
| 2,065,480 | A | | 12/1936 | Soper | |
| 2,307,181 | A | * | 1/1943 | Young | 383/82 |
| 2,371,404 | A | | 3/1945 | Mumford | |
| 2,391,926 | A | | 1/1946 | Scott | |
| 2,492,699 | A | | 12/1949 | Houwink | |
| 2,685,964 | A | | 8/1954 | Brown | |
| 2,724,358 | A | | 11/1955 | Harris et al. | |
| 2,725,027 | A | | 11/1955 | Brandon et al. | |
| 2,794,192 | A | | 6/1957 | Paris | |
| 2,854,049 | A | | 9/1958 | Wyllie | |
| 2,968,272 | A | | 1/1961 | Berglund | |
| 2,979,008 | A | | 4/1961 | Whipple | |
| 2,997,973 | A | | 8/1961 | Hawthorne et al. | |
| 2,998,793 | A | | 9/1961 | Hawthorne et al. | |
| 3,001,501 | A | | 9/1961 | Hawthorne et al. | |

(List continued on next page.)

FOREIGN PATENT DOCUMENTS

| | | | |
|---|---|---|---|
| DE | 198 21 456 | A | 11/1999 |
| EP | 0 134 706 | A | 3/1985 |
| EP | 0 710 736 | A1 | 11/1994 |

(List continued on next page.)

OTHER PUBLICATIONS

"3–D Braided Composites—Design and Applications" by D. Brookstein, 6$^{th}$ European Conference on Composite Materials, Sep. 1993, pp. 225–230.

(List continued on next page.)

*Primary Examiner*—S. Joseph Morano
*Assistant Examiner*—Andrew Wright
(74) *Attorney, Agent, or Firm*—Frommer Lawrence & Haug LLP; Ronald R. Santucci

(57) ABSTRACT

A flexible fluid containment vessel fabricated out of fabric for transporting and containing a large volume of fluid, particularly fresh water, having tapered front and/or rear portions formed out of the intermediate tubular structure, including a method of making the same.

29 Claims, 12 Drawing Sheets

U.S. PATENT DOCUMENTS

| | | | | | |
|---|---|---|---|---|---|
| 3,018,748 | A | | 1/1962 | Denis et al. | |
| 3,056,373 | A | | 10/1962 | Hawthorne et al. | |
| 3,067,712 | A | | 12/1962 | Doerpinghaus | |
| 3,150,627 | A | | 9/1964 | Stewart et al. | |
| 3,167,103 | A | | 1/1965 | Hawthorne et al. | |
| 3,224,403 | A | | 12/1965 | Paddington | |
| 3,282,361 | A | | 11/1966 | Mackie | |
| 3,289,721 | A | | 12/1966 | Benson | |
| 3,296,994 | A | | 1/1967 | Schirtzinger | |
| 3,502,046 | A | | 3/1970 | Stauber | |
| 3,622,437 | A | | 11/1971 | Hobaica et al. | |
| 3,661,693 | A | | 5/1972 | Pierson | |
| 3,672,319 | A | | 6/1972 | Platzer | |
| 3,731,854 | A | * | 5/1973 | Casey | 222/386.5 |
| 3,739,410 | A | | 6/1973 | Fortin | |
| 3,762,108 | A | | 10/1973 | Pierson | |
| 3,774,563 | A | | 11/1973 | Anderson, Sr. et al. | |
| 3,779,196 | A | | 12/1973 | Knaus et al. | |
| 3,797,445 | A | | 3/1974 | Zeimer | |
| 3,812,805 | A | | 5/1974 | Forssell et al. | |
| 3,839,977 | A | | 10/1974 | Bradberry | |
| 3,952,679 | A | | 4/1976 | Grihangne | |
| 3,955,524 | A | | 5/1976 | Renoux | |
| 3,974,789 | A | | 8/1976 | De Groot | |
| 4,108,101 | A | | 8/1978 | Schirtzinger | |
| 4,176,700 | A | * | 12/1979 | Mettler et al. | 383/98 |
| 4,227,474 | A | | 10/1980 | Ullrich | |
| 4,227,477 | A | | 10/1980 | Preus | |
| 4,227,478 | A | | 10/1980 | Preus | |
| 4,230,061 | A | | 10/1980 | Roberts et al. | |
| 4,373,462 | A | | 2/1983 | Fish | |
| 4,399,765 | A | | 8/1983 | Alkner et al. | |
| 4,506,623 | A | | 3/1985 | Roper et al. | |
| 4,509,558 | A | | 4/1985 | Slater | |
| 4,510,201 | A | | 4/1985 | Takeuchi et al. | |
| 4,582,756 | A | | 4/1986 | Niinuma et al. | |
| 4,662,386 | A | | 5/1987 | Pedersen | |
| 4,726,986 | A | | 2/1988 | Cannady, Jr. et al. | |
| 4,910,817 | A | | 3/1990 | Kita | |
| 4,933,231 | A | | 6/1990 | Seber | |
| 4,948,658 | A | | 8/1990 | Haelker | |
| 4,998,498 | A | | 3/1991 | Gallichan | |
| 5,082,726 | A | | 1/1992 | Bastiaens et al. | |
| 5,194,459 | A | | 3/1993 | Sato et al. | |
| 5,203,272 | A | | 4/1993 | Kassinger et al. | |
| 5,235,928 | A | | 8/1993 | Shank, Jr. | |
| 5,238,537 | A | | 8/1993 | Dutt | |
| 5,243,925 | A | | 9/1993 | Fortenberry | |
| 5,262,230 | A | | 11/1993 | Becker et al. | |
| 5,355,819 | A | | 10/1994 | Hsia et al. | |
| 5,360,656 | A | | 11/1994 | Rexfelt et al. | |
| 5,391,424 | A | | 2/1995 | Kolzer | |
| 5,413,065 | A | | 5/1995 | Spragg et al. | |
| 5,421,128 | A | | 6/1995 | Sharpless et al. | |
| 5,431,970 | A | | 7/1995 | Broun et al. | |
| 5,482,763 | A | | 1/1996 | Shaffer | |
| 5,488,921 | A | | 2/1996 | Spragg | |
| 5,503,291 | A | | 4/1996 | Craig | |
| 5,505,557 | A | | 4/1996 | Bradley | |
| 5,544,612 | A | | 8/1996 | Eymard | |
| 5,657,714 | A | | 8/1997 | Hsia et al. | |
| 5,691,390 | A | | 11/1997 | Harrison et al. | |
| 5,713,399 | A | | 2/1998 | Collette et al. | |
| 5,735,083 | A | | 4/1998 | Brown et al. | |
| 5,780,144 | A | | 7/1998 | Bradley | |
| 5,790,304 | A | | 8/1998 | Sanders et al. | |
| 5,865,045 | A | | 2/1999 | Wagner et al. | |
| 5,901,752 | A | * | 5/1999 | Lundman | 138/93 |
| 5,902,070 | A | | 5/1999 | Bradley | |
| 5,921,421 | A | | 7/1999 | Faquan | |
| 5,951,345 | A | | 9/1999 | Perratone et al. | |
| 6,003,565 | A | | 12/1999 | Whittier, II et al. | |
| 6,047,655 | A | | 4/2000 | Cran | |
| 6,056,438 | A | | 5/2000 | Bradley | |
| 6,086,968 | A | | 7/2000 | Horovitz | |
| 6,101,964 | A | | 8/2000 | Lesesne | |
| 6,290,818 | B1 | | 9/2001 | Romanski | |

FOREIGN PATENT DOCUMENTS

| | | | |
|---|---|---|---|
| EP | 0 687 625 | | 12/1995 |
| EP | 0 862 870 | A | 9/1998 |
| EP | 0 832 032 | B1 | 4/1999 |
| FR | 2 325 837 | | 4/1977 |
| FR | 2595621 | | 9/1987 |
| GB | 824 984 | A | 12/1959 |
| GB | 826 301 | A | 12/1959 |
| GB | 907 266 | | 10/1962 |
| GB | 933 899 | A | 8/1963 |
| GB | 1 079 766 | | 8/1967 |
| GB | 117552 | | 6/1968 |
| GB | 1117553 | | 6/1968 |
| JP | 60 219243 | A | 11/1985 |
| WO | WO 97/14622 | A | 4/1997 |
| WO | WO 97/49541 | | 12/1997 |
| WO | WO 98/01359 | A | 1/1998 |
| WO | WO 01 63033 | | 8/2001 |

OTHER PUBLICATIONS

Pages from web site of Bradley Industrial Textiles, Inc.

International Search Report issued by European Patent Office on Jul. 9, 2002 for PCT/US02/10694 filed Apr. 5, 2002.

International Search Report issued by the European Patent Office on Feb. 6, 2003 for PCT/US02/34299.

International Search Report issued by the European Patent Office on Feb. 10, 2003 for PCT/US02/34052.

International Search Report issued by the European Patent Office on Mar. 12, 2003 for PCT/US02/34004.

*McGraw–Hill Encyclopedia of Science and Technology, 6th edition*, 1987, McGraw–Hill Book Company, New York XP002203699 18 pp. 247–248 Paragraph 4; figures 6–8.

* cited by examiner

FIG. 4D
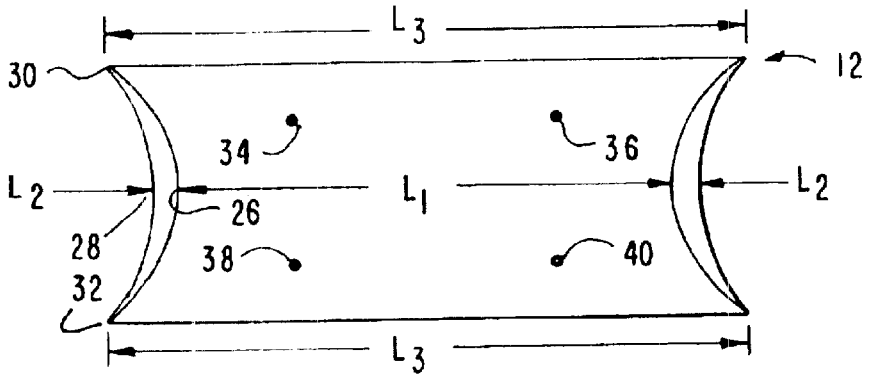
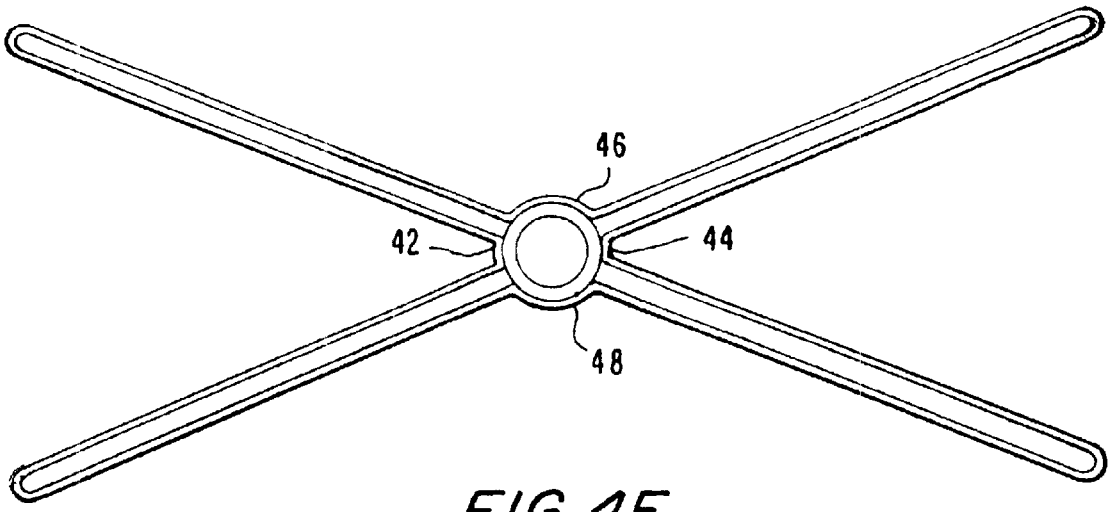
FIG. 4E

FIG. 7A
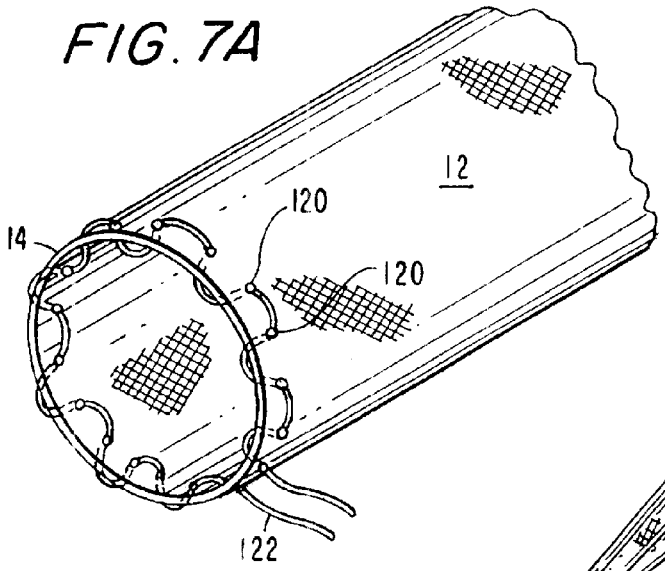
FIG. 7B
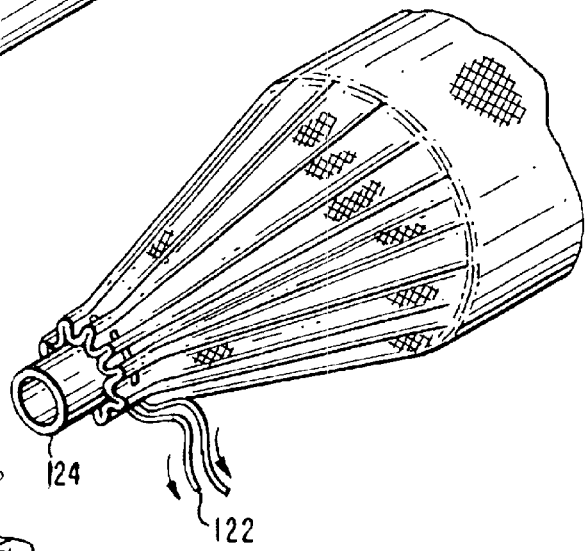
FIG. 7C
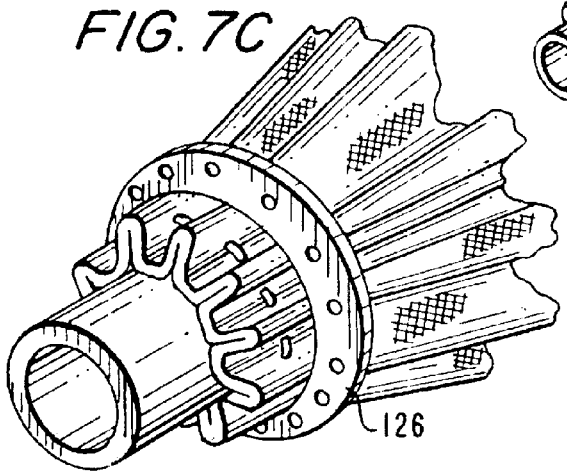
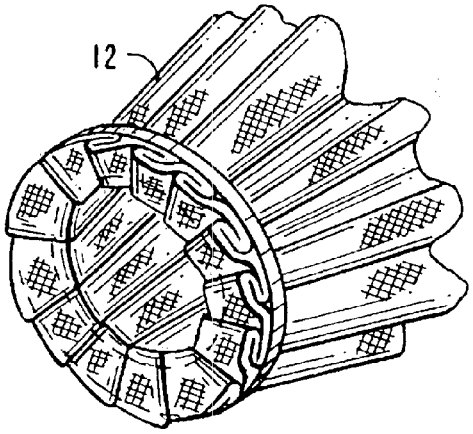
FIG. 7D
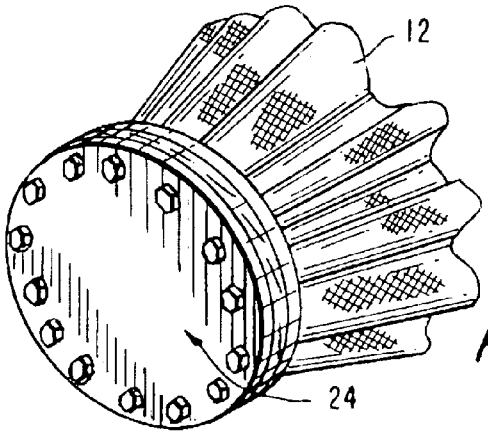
FIG. 7E

END PORTIONS FOR A FLEXIBLE FLUID CONTAINMENT VESSEL AND A METHOD OF MAKING THE SAME

CROSS-REFERENCE TO RELATED APPLICATIONS

This application is a continuation-in-part of U.S. Ser. No. 09/908,877 filed Jul. 18, 2001 entitled "Spiral Formed Flexible Fluid Containment Vessel" the disclosure of which is incorporated by reference herein which is a continuation-in-part of U.S. Ser. No. 09/832,739 filed Apr. 11, 2001 entitled "Flexible Fluid Containment Vessel" the disclosure of which is incorporated by reference herein.

FIELD OF THE INVENTION

The present invention relates to a flexible fluid containment vessel (sometimes hereinafter referred to as "FFCV") for transporting and containing a large volume of fluid, particularly fluid having a density less than that of salt water, more particularly, fresh water, and a method of making the same.

BACKGROUND OF THE INVENTION

The use of flexible containers for the containment and transportation of cargo, particularly fluid or liquid cargo, is known. It is well known to use containers to transport fluids in water, particularly, salt water.

If the cargo is fluid or a fluidized solid that has a density less than salt water, there is no need to use rigid bulk barges, tankers or containment vessels. Rather, flexible containment vessels may be used and towed or pushed from one location to another. Such flexible vessels have obvious advantages over rigid vessels. Moreover, flexible vessels, if constructed appropriately, allow themselves to be rolled up or folded after the cargo has been removed and stored for a return trip.

Throughout the world there are many areas which are in critical need of fresh water. Fresh water is such a commodity that harvesting of the ice cap and icebergs is rapidly emerging as a large business. However, wherever the fresh water is obtained, economical transportation thereof to the intended destination is a concern.

For example, currently an icecap harvester intends to use tankers having 150,000 ton capacity to transport fresh water. Obviously, this involves, not only the cost in using such a transport vehicle, but the added expense of its return trip, unloaded, to pick up fresh cargo. Flexible container vessels, when emptied can be collapsed and stored on, for example, the tugboat that pulled it to the unloading point, reducing the expense in this regard.

Even with such an advantage, economy dictates that the volume being transported in the flexible container vessel be sufficient to overcome the expense of transportation. Accordingly, larger and larger flexible containers are being developed. However, technical problems with regard to such containers persist even though developments over the years have occurred. In this regard, improvements in flexible containment vessels or barges have been taught in U.S. Pat. Nos. 2,997,973; 2,998,973; 3,001,501; 3,056,373; and 3,167,103. The intended uses for flexible containment vessels is usually for transporting or storing liquids or fluidisable solids which have a specific gravity less than that of salt water.

The density of salt water as compared to the density of the liquid or fluidisable solids reflects the fact that the cargo provides buoyancy for the flexible transport bag when a partially or completely filled bag is placed and towed in salt water. This buoyancy of the cargo provides flotation for the container and facilitates the shipment of the cargo from one seaport to another.

In U.S. Pat. No. 2,997,973, there is disclosed a vessel comprising a closed tube of flexible material, such as a natural or synthetic rubber impregnated fabric, which has a streamlined nose adapted to be connected to towing means, and one or more pipes communicating with the interior of the vessel such as to permit filling and emptying of the vessel. The buoyancy is supplied by the liquid contents of the vessel and its shape depends on the degree to which it is filled. This patent goes on to suggest that the flexible transport bag can be made from a single fabric woven as a tube. It does not teach, however, how this would be accomplished with a tube of such magnitude. Apparently, such a structure would deal with the problem of seams. Seams are commonly found in commercial flexible transport bags, since the bags are typically made in a patch work manner with stitching or other means of connecting the patches of water proof material together. See e.g. U.S. Pat. No. 3,779,196. Seams are, however, known to be a source of bag failure when the bag is repeatedly subjected to high loads. Seam failure can obviously be avoided in a seamless structure. However, a seamed structure is an alternative to a simple woven fabric as it would have different advantages thereto, particularly in the fabrication thereof.

In this regard, U.S. Pat. No. 5,360,656 entitled "Press Felt and Method of Manufacture", which issued Nov. 1, 1994 and is commonly assigned, the disclosure of which is incorporated by reference herein, discloses a base fabric of a press felt that is fabricated from spirally wound fabric strips.

The length of fabric will be determined by the length of each spiral turn of the fabric strip of yarn material and its width determined by the number of spiral turns.

An edge joint can be achieved, e.g. by sewing, melting, and welding (for instance, ultrasonic welding as set forth in U.S. Pat. No. 5,713,399 entitled "Ultrasonic Seaming of Abutting Strips for Paper Machine Clothing" which issued Feb. 3, 1998 and is commonly assigned, the disclosure of which is incorporated herein by reference) of non-woven material or of non-woven material with melting fibers.

While that patent relates to creating a base fabric for a press felt such technology may have application in creating a sufficiently strong tubular structure for a transport container. Moreover, with the intended use being a transport container, rather than a press fabric where a smooth transition between fabric strips is desired, this is not a particular concern and different joining methods (overlapping and sewing, bonding, stapling, etc.) are possible. Other types of joining may be apparent to one skilled in the art.

Furthermore, while as aforenoted, a seamless flexible container is desirable and has been mentioned in the prior art, the means for manufacturing such a structure has its difficulties. Heretofore, as noted, large flexible containers were typically made in smaller sections which were sewn or bonded together. These sections had to be water impermeable. Typically such sections, if not made of an impermeable material, could readily be provided with such a coating prior to being installed. The coating could be applied by conventional means such as spraying or dip coating.

Another problem is how to seal the end of the container especially where there is tapering at the end desired. While end portions can be made separately and attached to the tubular structure, examples of which are set forth in the aforesaid applications and the references cited therein, it may be desirable to have the end portions formed out of the tubular structure itself and formed into a desired shape (i.e. cone shaped etc.). In this regard, for example, U.S. Pat. No. 2,997,973 issued on Aug. 29, 1961 to Hawthorne shows the use of pleating of the fabric at the ends which are then glued and/or sewn to provide the desired shape.

Accordingly, there exists a need for a FFCV for transporting large volumes of fluid which overcomes the aforenoted problems attendant to such a structure and the environment in which it is to operate.

SUMMARY OF THE INVENTION

It is therefore a principal object of the invention to provide for a relatively large fabric FFCV for the transportation of cargo, including, particularly, fresh water, having a density less than that of salt water.

It is a further object of the invention to provide for such an FFCV which has means of sealing the ends thereof in a desired manner.

It is a further object of the invention to provide means for sealing the ends of such an FFCV by tapering.

A further object of the invention is to provide for a means for sealing the ends of such an FFCV so as to effectively distribute the load thereon.

These and other objects and advantages will be realized by the present invention. In this regard the present invention envisions the use of a woven or spirally formed tube to create the FFCV, having a length of 300' or more and a diameter of 40' or more. Such a large structure can be fabricated on machines that make papermaker's clothing. The ends of the tube, sometimes referred to as the nose and tail, or bow and stern, may be sealed by a number of means, including being pleated, folded or otherwise reduced in diameter and bonded, stitched, stapled or maintained by a mechanical coupling. More particularly, while the aforesaid patent applications disclose end portions which may be affixed to the tube or spirally formed, the present invention is directed towards making the end portions out of the tube itself. In the case of a tube formed having a large uniform circumference of perhaps 40 to 75 meters or more, it would be necessary to reduce the circumference down so as to allow an end cap or tow member to be affixed thereto. While doing so, it is desired to shape the end portion such as that of a cone or the bow of a ship, while maintaining a unitized construction. Several methods for doing this in a spiral formed FFCV are disclosed in the first aforesaid patent application. Alternative methods are disclosed hereinwith.

Several methods are envisioned whilst bearing in mind the desire to avoid stress concentrations. The first method involves folding over and pleating the ends of the tube. The pleats extend over the length of the end portion of the tube with the degree of overlapping increasing as it approaches the end so that the desired mechanical coupling can be affixed. Such graduations of the pleating allows for a smooth transition and for cones to be formed in both the front and rear. The pleats can also be folds of fabric folded upon themselves in stacks or in groups. The pleats may also extend over the entire length of the tube which, with the exception of the ends, will expand upon filling the tube. An appropriate means for securing the pleats in place is provided.

A second method involves the shaping of the bow into a desired taper by folding the tube along focal points which gradually increases the degree of the fold and then securing the end about fold facilitators and securing it. An appropriate tow bar may be attached at the nose.

A third method involves a sprocket or tooth type arrangement at the end of the tube so as to reduce its circumference. In this regard, the fabric has folded portions that extend radially upward perpendicular to the circumference of the tube. The degree of the fold increases from a minimum to a maximum at which point a mechanical end closure device is affixed.

A fourth method involves radial folds of fabric in a star shaped pattern mechanically fixed in place about the end circumference of the tube.

A fifth method involves the creation of a taper at the end of the tube during the weaving, braiding or knitting process of creating the tube. For example, in the tubular weaving process, a taper can be created by removing or eliminating warp yarns in a sequential fashion and tying them off.

A sixth method involves gathering the fabric at the end of the tube about a mandrel, folding it back and mechanically securing it.

In all cases, of course, an opening or openings are provided for filling and emptying the cargo such as those disclosed in U.S. Pat. Nos. 3,067,712 and 3,224,403.

BRIEF DESCRIPTION OF THE DRAWINGS

Thus by the present invention its objects and advantages will be realized, the description of which should be taken in conjunction with the drawings, wherein:

FIGS. 3A–3D show perspective views of the arrangement wherein pleating is along the length of the FFCV shown unexpanded, partially expanded and, somewhat fully expanded, incorporating the teachings of the present invention;

FIGS. 4A–4H are somewhat general perspective view of a FFCV which shows the steps for folding about focus points so as to create an FFCV having a bow or stern as shown in FIG. 4H incorporating the teachings of the present invention;

FIGS. 7A–7E are somewhat perspective views of an FFCV showing the steps to effect the closure of its ends in a further embodiment, incorporating the teachings of the present invention.

DETAILED DESCRIPTION OF THE PREFERRED EMBODIMENTS

Figure 1:
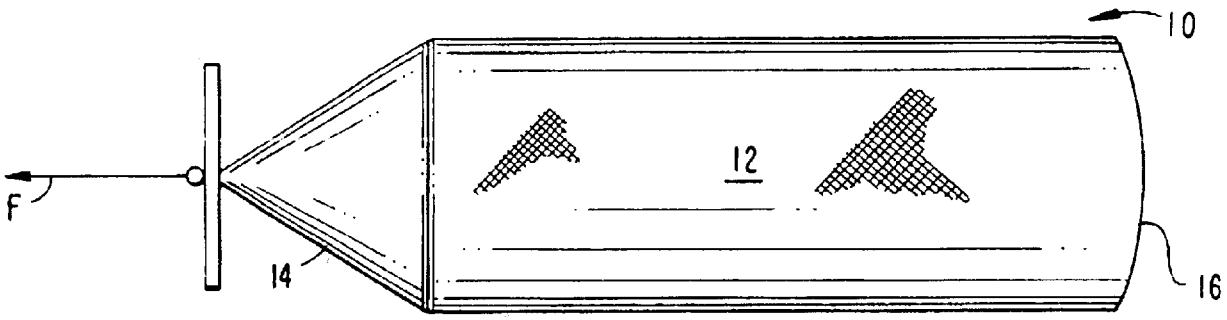
FIG. 1 PRIOR ART
FIG. 1 is a somewhat general perspective view of a known FFCV which is cylindrical having a pointed bow or nose.

The FFCV 10 generally is intended to be constructed of an impermeable textile tube. While the tube or tubular structure 12 configuration may vary, the tube is shown generally (in FIG. 1) as being cylindrical having a substantially uniform diameter (perimeter) and then closed and sealed on each end 14 and 16. The respective ends 14 and 16 may be closed in any number of ways, as will be discussed and it is that to which the present invention is directed. The resulting impermeable structure will also be flexible enough to be folded or wound up for transportation and storage.

Before discussing more particularly the FFCV design of the present invention, it is important to take into consideration certain design factors. The even distribution of the towing load and the stability of the FFCV is crucial to the life and performance of the FFCV.

The towing force should be minimized as a function of towing speed. Commonly, FFCVs are designed to look something like a submarine. This is to say that FFCVs have a tapered bow and stern. Stability is important as a towing phenomenon known as snaking can destroy an FFCV by way of uncontrolled sinusoidal oscillations. The shape of the FFCV will determine if the bag will be stable during towing.

While the aforesaid patent applications discuss the various forces important in the design of the FFCV, the present application is directed to methods of closing the bow and/or stern of an FFCV. The present invention envisions a tapered structure whilst avoiding stress concentrations or otherwise compromising the integrity of the tube. In addition, the tapered portion may be so formed so as to be integral with the tube and by forming it out of the tube itself, creates a mass of fabric, particularly at the bow portion where the stress load is the highest. Such a mass of fabric allows the FFCV to distribute the load placed thereon and avoids the need to affix separate end caps.

With this in mind, we turn now to the general construction of the tube 12 which will make up the FFCV. In this regard, and as disclosed in the second aforesaid application, the tube 12 may be woven seamless. It may also be knit or braided seamless as an integral piece. Large textile looms such as those owned and operated by Albany International Corp. for making papermakers fabric can weave such a large tube 12. The particulars for its fabrication, the material used, the fibers and coatings, etc. are set forth in said application and, accordingly, will not be repeated herein. Alternatively, the tube 12 may be made in a manner involving spiral forming as set forth in the first aforesaid application and as disclosed in U.S. Pat. No. 5,360,656 entitled "Press Felt and Method of Manufacturing It" which issued Nov. 1, 1994, the disclosure of which is incorporated herein by reference.

Since the tube 12 is essentially an elongated cylindrical fabric, the method of manufacturing described in that reference can be utilized to create a tube 12 for the FFCV 10. The particulars of the fabrication of the tube, the materials used, for the fabric strips and coating are set forth in said application and again will not be repeated herein.

While sealing at the end of the tube 12 can be in a manner as described in the aforesaid patent applications, other methods of creating the end portions to which the present invention is directed are hereinafter described.

Figure 2A:
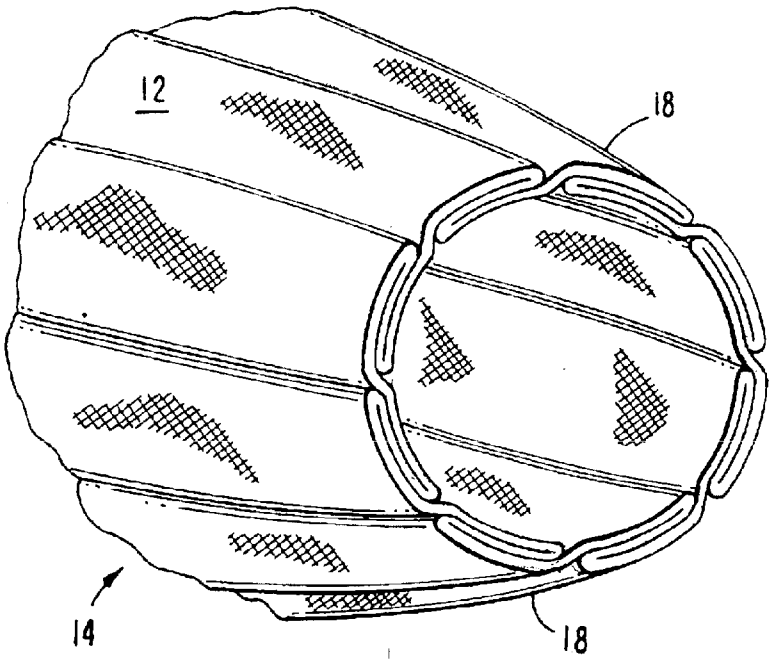
FIGS. 2A, 2B and 2C are somewhat general perspective views of an FFCV having pleating along its bow (and at its stern) incorporating the teachings of the present invention.
Figure 2B:
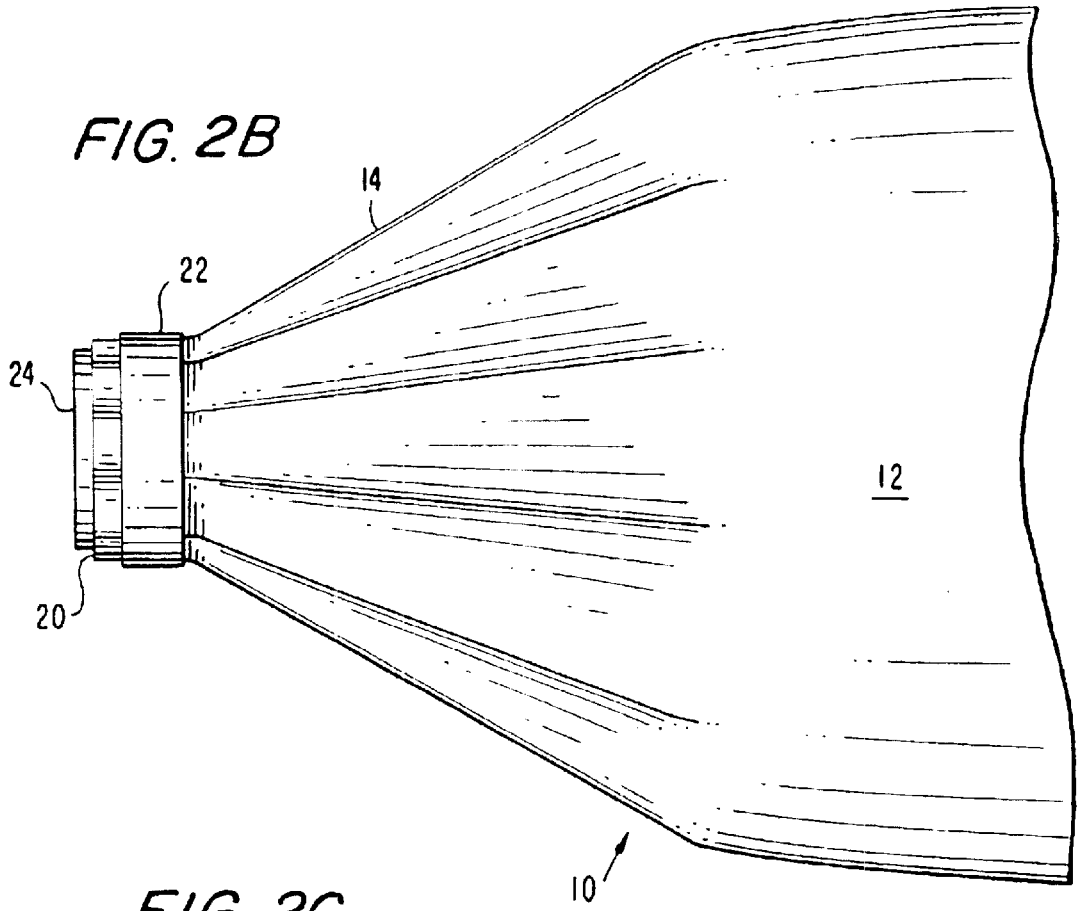

In this regard, reference is made to FIGS. 2A and 2B. The FFCV 10 shown includes a tube 12 and end portions generally designated 14 for the bow and 16 for the stern (not shown in these figures). The construction shown allows one to convert a tube 12 into a cone shaped bow 14 and/or a cone shaped stern 16. Pleating is a means to convert the end of the tube 12 into a smaller diameter. The pleats 18 are formed about the circumference of the tube 12 so as to allow for the end of the tube 12 to become tapered.

By way of example, assume that the tube 12 measures 40 meters in circumference. Assume that the ends of the tube need to be made into smaller diameters having a circumference of 2 meters. In this example, pleats of equal size will be made such that there are a total of 40 pleats. Given that each pleat is of equal size, the unit size of each pleat must comprise $1/20^{th}$ of a meter (5 centimeters) of the sealed surface in the tube end (2 meter circumference divided by 40 pleats). Since the original circumference was 40 meters, each pleat must contain 1 meter of folded or pleated fabric. Since the amount of fabric exposed to the sealing surface is 5 centimeters, 95 centimeters of fabric makes up the remaining folded part of the pleat.

The pleats 18 can be made in either a clockwise direction or a counterclockwise direction. The pleats 18 can be made in a combination of clockwise and counterclockwise pleats. The pleats 18 can be of equal size or unequal size. The pleats 18 may also be graduated along the end portion or bow 14. That being a small overlap furthest from the end 20 with the greatest overlap at end 20 as shown in FIG. 2B.

The pleats 18 can also be made such that they are formed at an angle to the axis of the tube 12. These angled pleats 18 are likely to allow for more even stress distribution when the FFCV is filled with a liquid and towed.

Figure 2C:
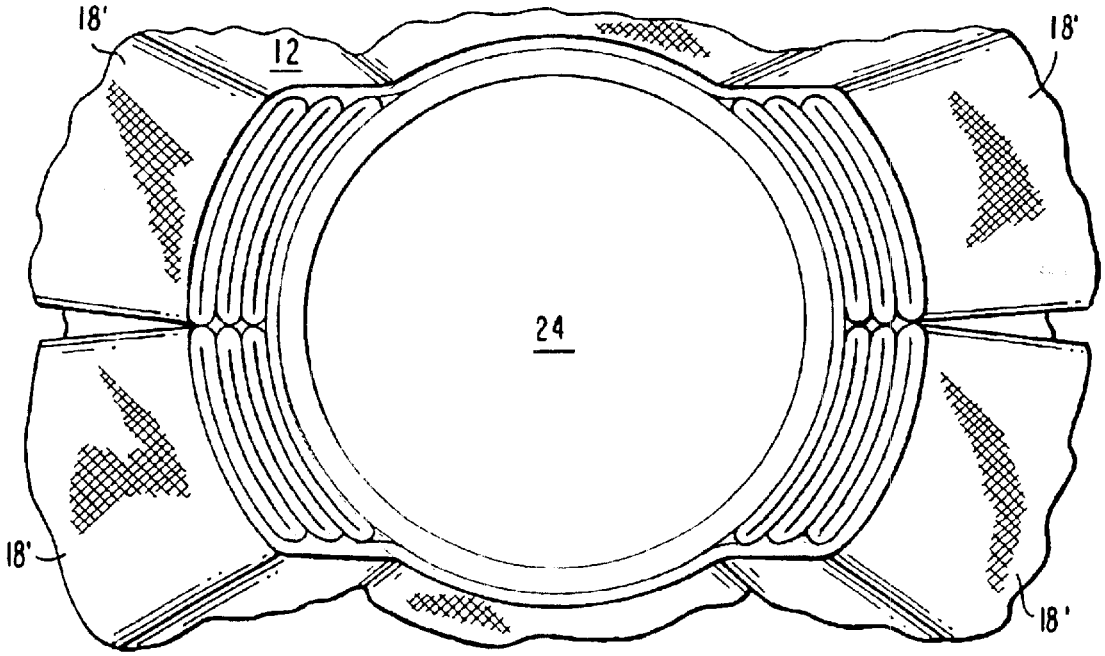

As shown in FIG. 2C, the pleats 18' may take the form of groups or stacks (four shown) of folded fabric where the fabric is gathered and folded upon itself. Other variations of folding will be apparent to one skilled in the art.

The pleated design provides an effective means to distribute towing stresses. Typically, the stresses at the bow and stern are concentrated on a small amount of fabric. The pleated design provides more fabric at the stern and bow for handling the towing stresses. This is important since the towing stresses are highest at the bow and stern of the FFCV.

The pleated structure can be made either manually or with the aid of a mechanized pleating machine. Both methods of manufacturing require that the fabric be prepared such that the pleats are made according to the design specified. For example, one may mark the tube 12 to show the pleating layout that would include the size of the pleats, the direction of the pleats, and the angle of the pleats.

The ends 20 of the bow 14 and/or stern 16 of the FFCV 10 would be provided with a mechanical clamp or band 22 which would secure the pleats 18 and 18'. An end fitting 24 would also be provided. Such fittings 24 are attached to the pleated ends. The fittings enable the FFCV 10 to be sealed or opened as required during use. The fittings 24 may have both internally and externally exposed components. These components, when assembled, would be the means for attaching or incorporating valves and/or hoses to the FFCV. Adhesive sealants would be used to produce a water tight seal between the fittings 24 and the pleats 18 making up the FFCV. These sealants would also be used to seal contacting surfaces of the fabric within the pleats 18 at the place where the fittings 24 are attached.

Figure 3A:
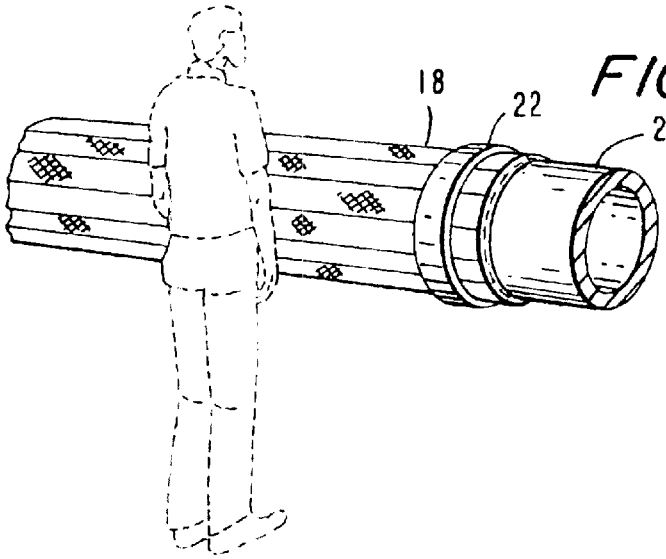
FIGS. 3A–3C show perspective views of the arrangement wherein pleating is along the length of the FFCV shown unexpanded, partially expanded and, somewhat fully expanded, incorporating the teachings of the present invention.
Figure 3B:
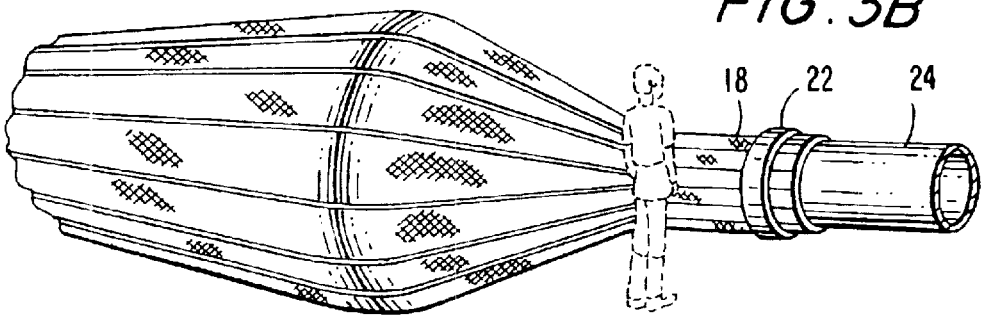
Figure 3C:
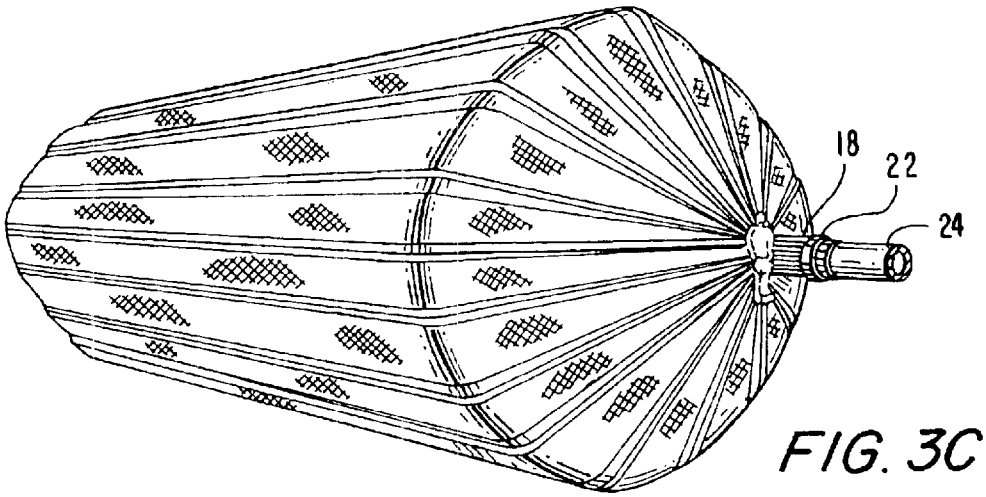

In addition, the pleats can be made such that the entire tube is pleated from bow to stern as shown in FIGS. 3A–3C. In this configuration, the pleats are substantially parallel to the axis of the tube 12 (see FIG. 3A). Upon filling of the FFCV 10 (see FIG. 3B), the pleats will unfold in the center of the FFCV, but remain folded near the bow 14 and/or stern 16 of the FFCV 10 (see FIG. 3C).

Figure 4A:
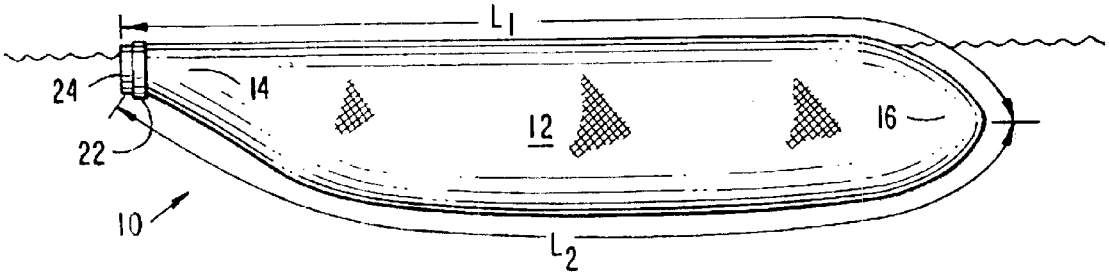

Turning now to an alternative way to form the bow and/or stern of an FFCV, in this regard reference is made to FIGS. 4A–4H. For purposes of example, the FFCV 10 will be assumed to have a maximum circumference of 62 meters and a length from bow to stern of 150 meters. The bow 14 and/or stern 16 of the FFCV have clamp or band 22 and a bow (or stern) connector or fitting 24 that measure 2 meters in diameter. FIG. 4A shows a cross sectional view of an FFCV 10 in the lengthwise direction. The bow 14 of the FFCV 10 rises up to the surface of the surrounding water. In contrast, the stern 16 is slightly submerged. In FIG. 4A two distances are noted. $L_1$ is shown as the distance from the bow 14 to the stern 16 running along the top center of the FFCV 10. $L_2$ is the distance from the bow 14 to the stern 16 running along the bottom center of the FFCV 10. $L_2$ is longer than $L_1$ due to the shape of the taper in the FFCV.

Figure 4B:
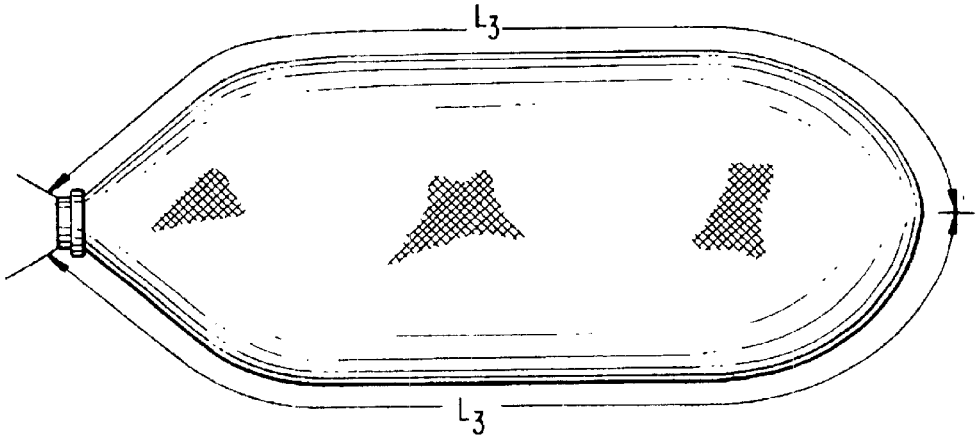

In FIG. 4B it shows a top view of the same FFCV 10 in FIG. 4A. In FIG. 4B, two equal distances are noted and indicated as $L_3$. $L_3$ is longer than $L_1$ or $L_2$. In summary, $L_3$ is longer than $L_2$ and $L_2$ is longer than $L_1$.

Figure 4C:
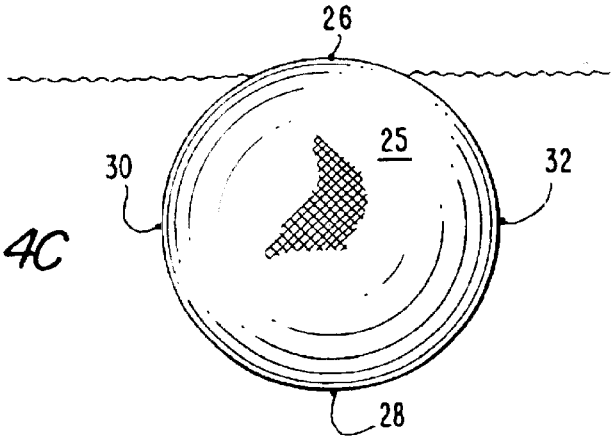

FIG. 4C shows the 2-meter diameter substantially rigid connector 25 at the bow of the FFCV. This figure shows the outer circumference of the connector 25 where the fabric of the FFCV is attached thereto. Note that the four locations on the connector 25 are top-center 26, bottom-center 28 and two other locations (starboard and port) 30 and 32 equidistant between the top-center 26 and bottom-center 28.

FIG. 4D shows the tube 12 that will be attached to the bow and stern connectors 25. The tube 12 is shown in a flat, collapsed position with the top-side of the coated fabric in the foreground. The distances $L_1$, $L_2$, and $L_3$ are the same as that shown in FIG. 4A. The marking of these distances correspond in a direct fashion with the four locations shown in FIG. 4C. For example, the top-center 26 shown in FIG. 4C will be the attachment location for the bow point of distance $L_1$. The bottom-center 28 shown in FIG. 4C will the attachment location for the bow point of $L_2$. The two other locations (starboard and port) 30, 32 shown in FIG. 4C are the attachment locations for the starboard 30 and port 32 points of the two $L_3$ distances.

Four focal points (34–40) are shown in the top surface of the tube 12. Two focal points 34 and 38 are shown in the bow 14 and two focal points 36 and 40 are in the stern 16. These focal points will be used in a folding operation which will be discussed. Four more focal points are located on the bottom-side of the tube 12 and as referred to herein will be designated with a similar number, however, with a prime (i.e. 38'). These additional focal points have similar positions corresponding to the focal points on top-side of the tube 12. The location of all the focal points is important, as they will determine the shape of the taper.

The shape of the fabric at the bow and stern is curved and/or angled between locations 30 and 32. This may be accomplished by cutting or other means suitable for the purpose. The shape of the cut end is designed to create a nearly blunt bow and stern when all the fabric of the tube 12 has been attached and secured in final form to the bow or stern connectors 25. The term blunt refers to achieving a finished end connection that is nearly perpendicular to the main axis of the FFCV. The connector 25 is not required to be exactly perpendicular to the main axis.

In FIG. 4D there is shown the initial attachment of the tube 12 shown in FIG. 4D to the connector 25 shown in FIG. 4C. Note that there are four points of attachment (42–48) shown in FIG. 4D. The fabric of the tube 12 is bolted and glued to the connector 25 using conventional techniques including a beaded edge to the fabric. A large portion of the fabric has yet to be connected to the connector 25.

Figure 4F:
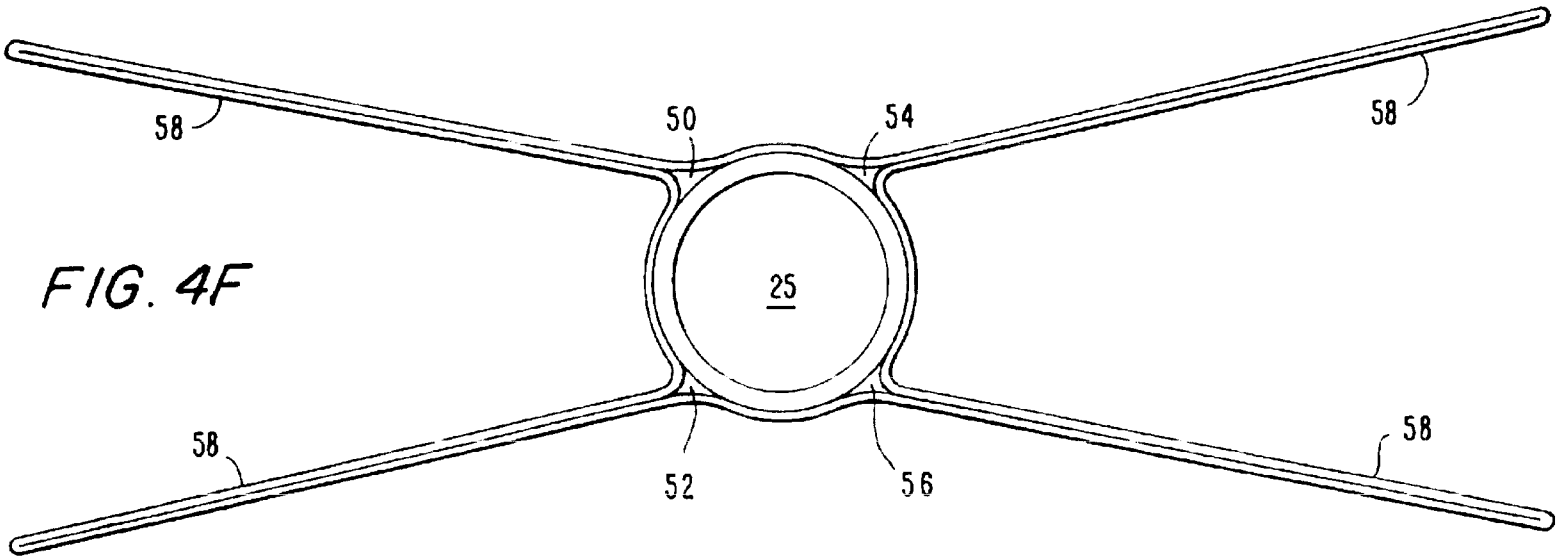

FIG. 4F shows fold facilitators 50–56 that are attached to the connector 25. These fold facilitators are triangular shaped attachments that will be used to facilitate clockwise and counterclockwise folding of the fabric that is to be attached to the connector 25. A portion of the fabric has been attached to each fold facilitator 50–56. This attachment is accomplished using conventional methods of bolting and gluing. The inner surfaces 58 of the unattached portions of the fabric in each quadrant are sealed to each other. Unlike other portions of the fabric, these unattached portions of the coated fabric do not require a beaded edge.

Figure 4G:
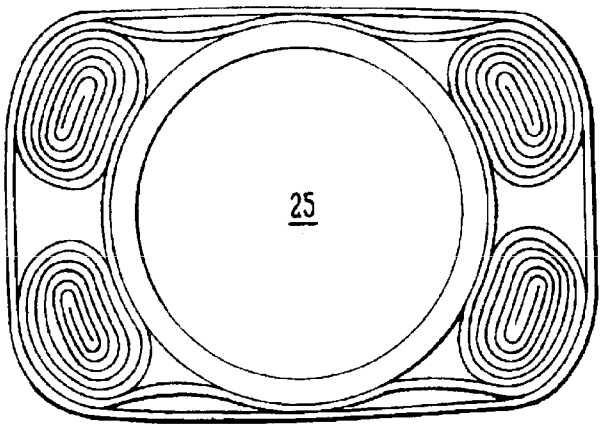
Figure 4H:
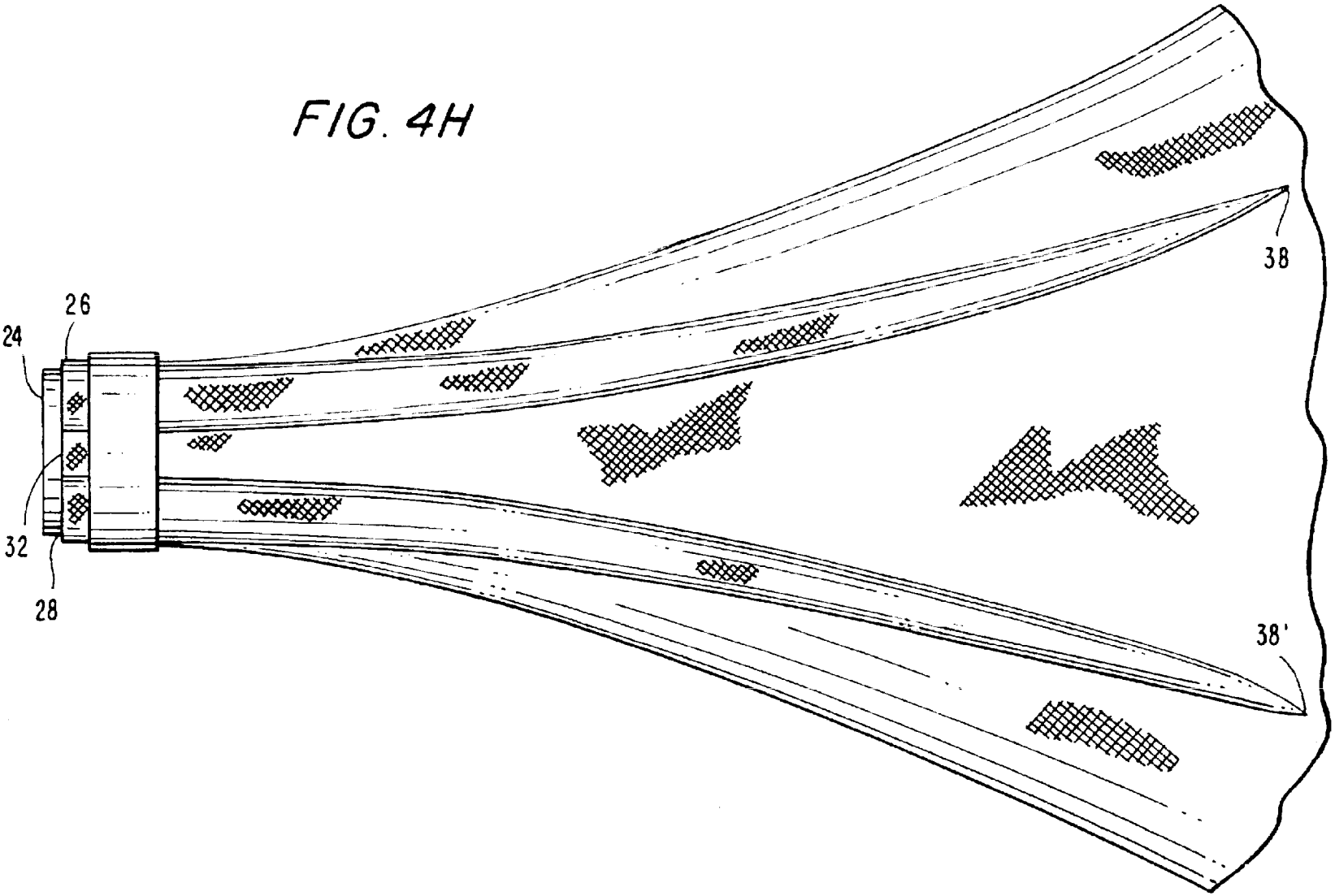

Once a sealant has been applied to the inner surface 58 of the unattached portions of the fabric, the unattached portion of the fabric is folded such that the folded fabric fits snuggly or tightly within or near each individual fold facilitator. Folding can be accomplished in at least three ways. One way is to roll the fabric onto itself so that the fabric forms into a spiral as shown in FIG. 4G. A second way is to fold the fabric back and forth in an oscillating fashion. The third way is to use a combination of oscillating and spiral folds to create a compact structure. Once folding is complete, the entire end structure is secured in place mechanically. To secure the structure is a circumferential clamp or strap 22 that tightens around the connector 25. Alternatively, the folds can be secured by bolting the fabric in place. The end result is shown in FIG. 4H.

Proper folding requires that the fold be formed on the basis of two parameters. One parameter is the focal point for each fold. The focal points shown in FIG. 4D determine the length and direction of each fold. The second parameter is the initial fold width as shown in FIG. 4G. The initial fold width determines how snuggly the fold fits within the fold facilitator. The combination of the fold width and focal point determine the shape of the taper that is achieved.

One of the important benefits of folding technology as in the case of the other embodiments is the strength retained in the bow and stern of the FFCV. The large amount of fabric retained in the bow and stern provides an easy means to carry and distribute the towing load throughout the FFCV 10. Distribution of the towing stress over a large amount of fabric minimizes wear and lengthens the life of the FFCV 10. Folding can also provide some stiffness in the overall structure. This stiffness can provide for stable towing characteristics.

Folding can be accomplished in such a way that the structure can be reeled up for storage or transportation. There are many variants possible on the folding method. For example, the number of points of attachment at the bow or stern could be as little as one or as many as six or more. The number of independent folds can also vary in number. The position of the focal points is something that can be varied to achieve different shapes for the taper. While the fold facilitators are not essential, if they are used, their shape could vary according to the desired effect that one is trying to achieve in the folded fabric.

An important aspect of the folding technology is the sealing of the internal surfaces of the unattached fabric to prevent leakage and contamination of the cargo. Effective sealing can be accomplished by means of mechanical fasteners, gluing, or other means suitable for the purpose.

The above focus primarily on the bow 14. The stern 16 would follow the same principles described above. The difference between the bow 14 and the stern 16 may be the shape of the taper.

Figure 5:
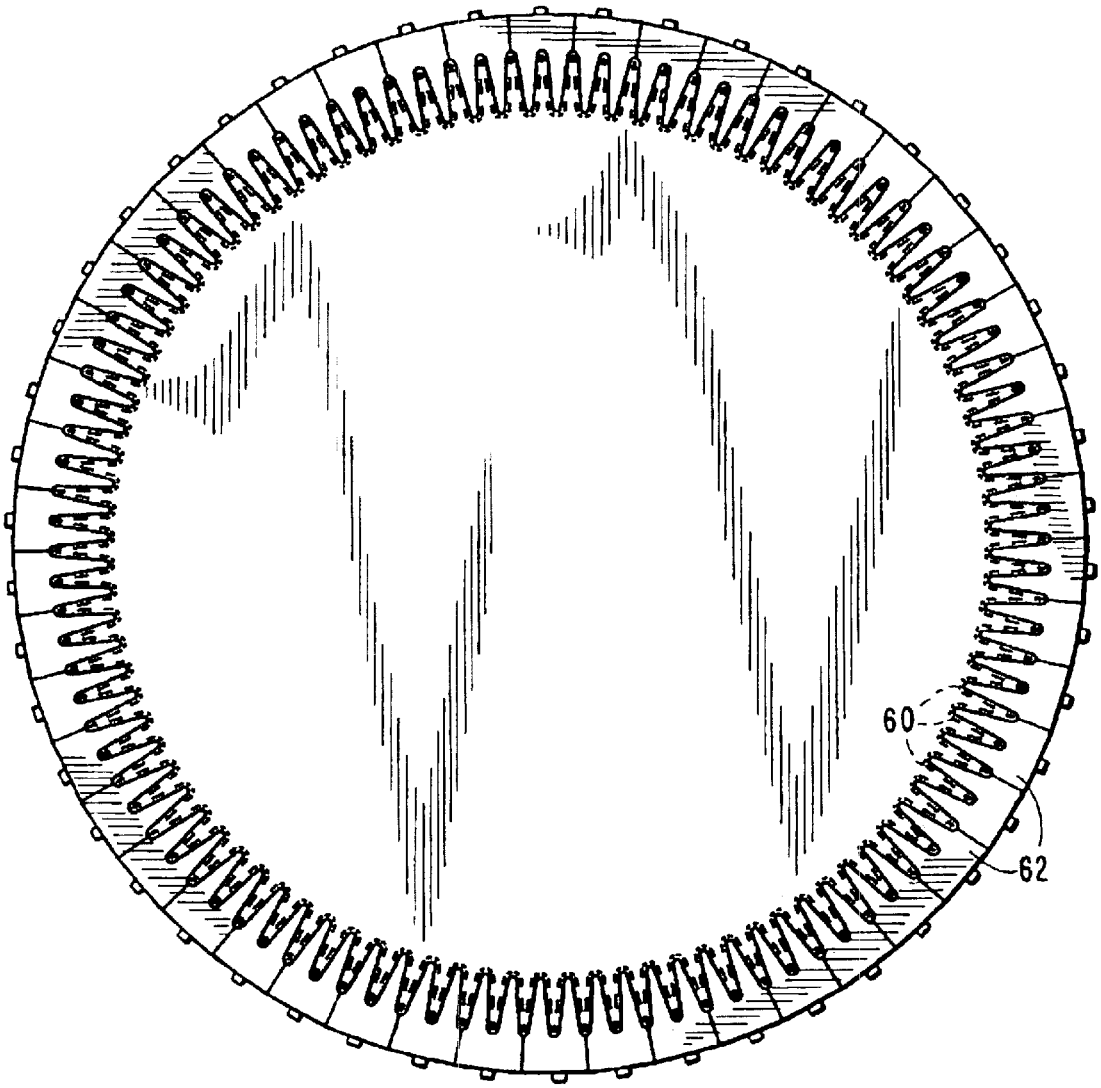
FIG. 5 is a frontal view of a FFCV having circumferential teeth or radial folds incorporating the teachings of the present invention.

Turning now to a further embodiment for reducing the circumference of the FFCV 10 at its bow 14 and/or stern 16, reference is made to FIGS. 55B. Again, the purpose is to reduce the circumference to create tapered ends without compromising the integrity of the tube 12 which is used to create the end portions. In this regard, as shown in FIG. 5, the bow 14 comprises a plurality of radially extending folds or teeth 60 of fabric. These folds extend around the circumference and are maintained in position by a plurality of end closure devices 62.

Figure 5B:
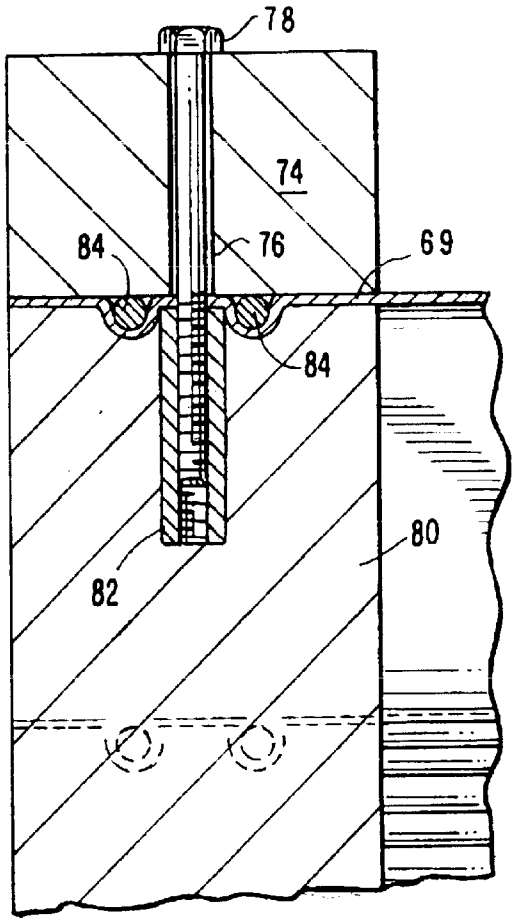
FIG. 5B is a sectional view along lines A—A of FIG. 5A incorporating the teachings of the present invention.
Figure 5A:
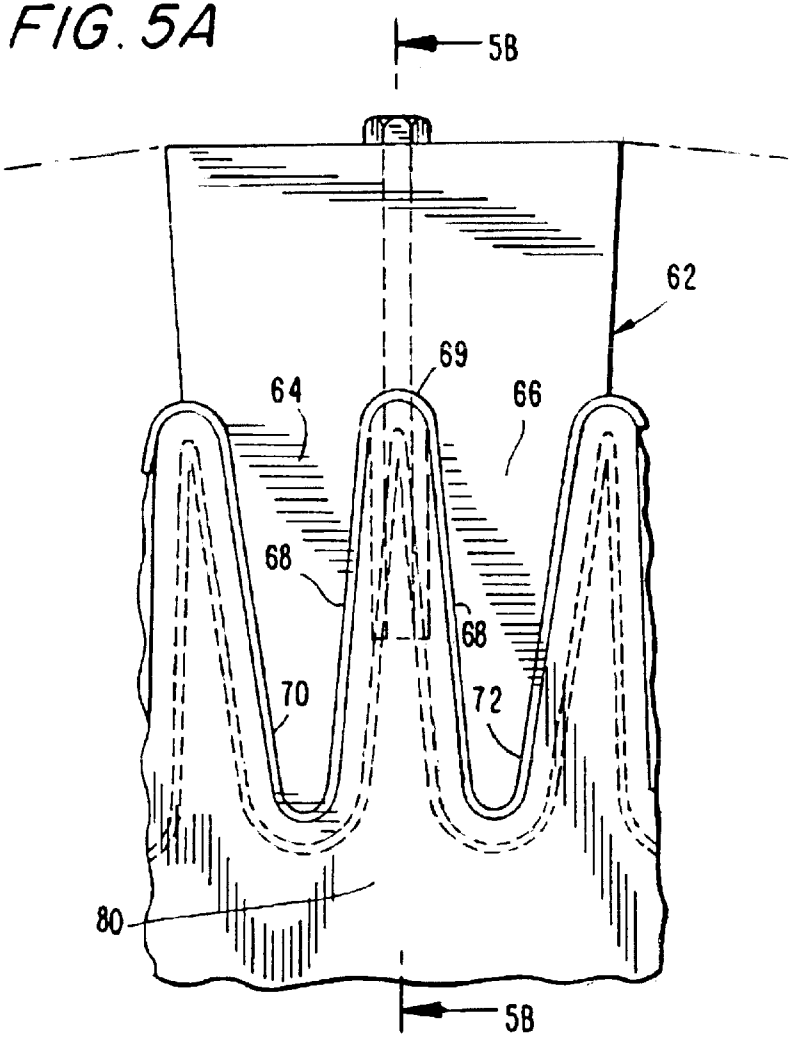
FIG. 5A is an enlarged view of the end closure devices shown in FIG. 5 incorporating the teachings of the present invention.

In this regard, reference is made to FIGS. 5A and 5B where the devices 62 are shown in more detail.

As shown, the device 62 comprises a structure having teeth 64 and 66 which provides support for a first fold 68 having an apex 69 along with support for respective sides of two adjacent folds 70 and 72. On the outer side of the fabric, device 62 comprises a rigid tooth like element 74, preferably made of metal such as aluminum with an aperture 76 through which a bolt 78 passes.

On the inside of the fabric is a flexible casting 80 which conforms the inner portion of the fabric to that of the tooth like element 70. Casting 80 includes a bolt receiving member or metal insert 82 which allows it to be bolted to element 74 after the bolt 78 passes through the fabric and the fabric is in position to conform to the desired shape. Positioned on either side of the bolt 78 and between element 74 and casting 80 are two circumferentially extending sealing beads 84.

As can be seen in FIG. 5, due to the configuration of element 62, it allows for every other fold to be bolted, since adjacent elements serve to maintain intermediate folds in position. Also, depending upon how much the tube 12 circumference is to be reduced, will dictate the depth of the fold and the number elements 62 used.

Figure 5C:
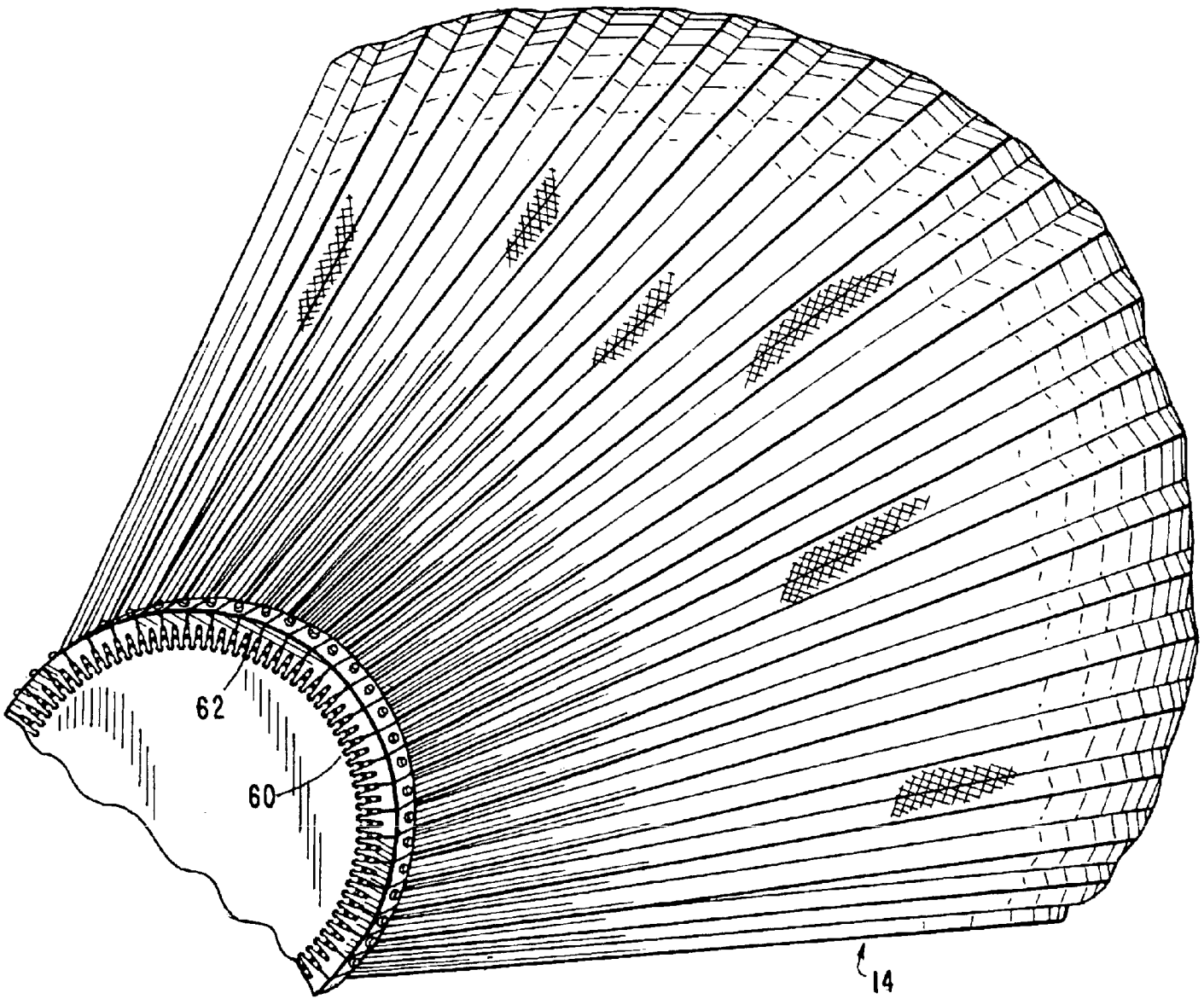
FIG. 5C is a partial perspective side view of the FFCV shown in FIG. 5A, incorporating the teachings of the present invention.

As shown in FIG. 5C, the use of the radial folds or teeth at the end of the tube will result in a gathering there behind of fabric along the lines defined by the folds gradually extending outward until the full original circumference is reached. Accordingly, a conical bow 14 is formed. The same can be done with the stern with an appropriate end closure added having fittings, etc. being mounted thereon.

Figure 6B:
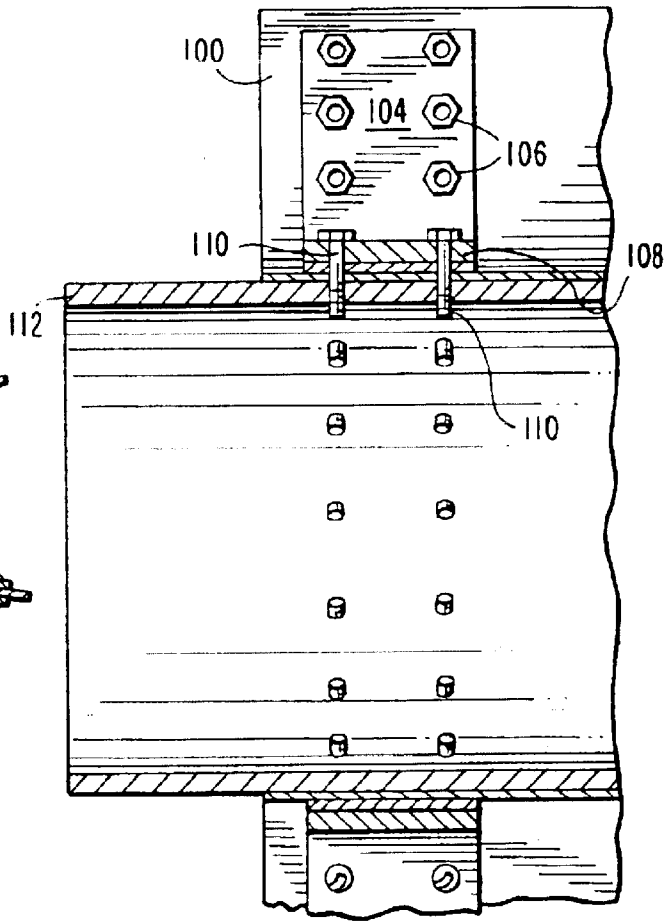
FIGS. 6A and 6B are frontal and side view of an FFCV showing a further embodiment having radial folds in a star shaped pattern which are maintained in clamps, incorporating the teachings of the present invention.
Figure 6A:
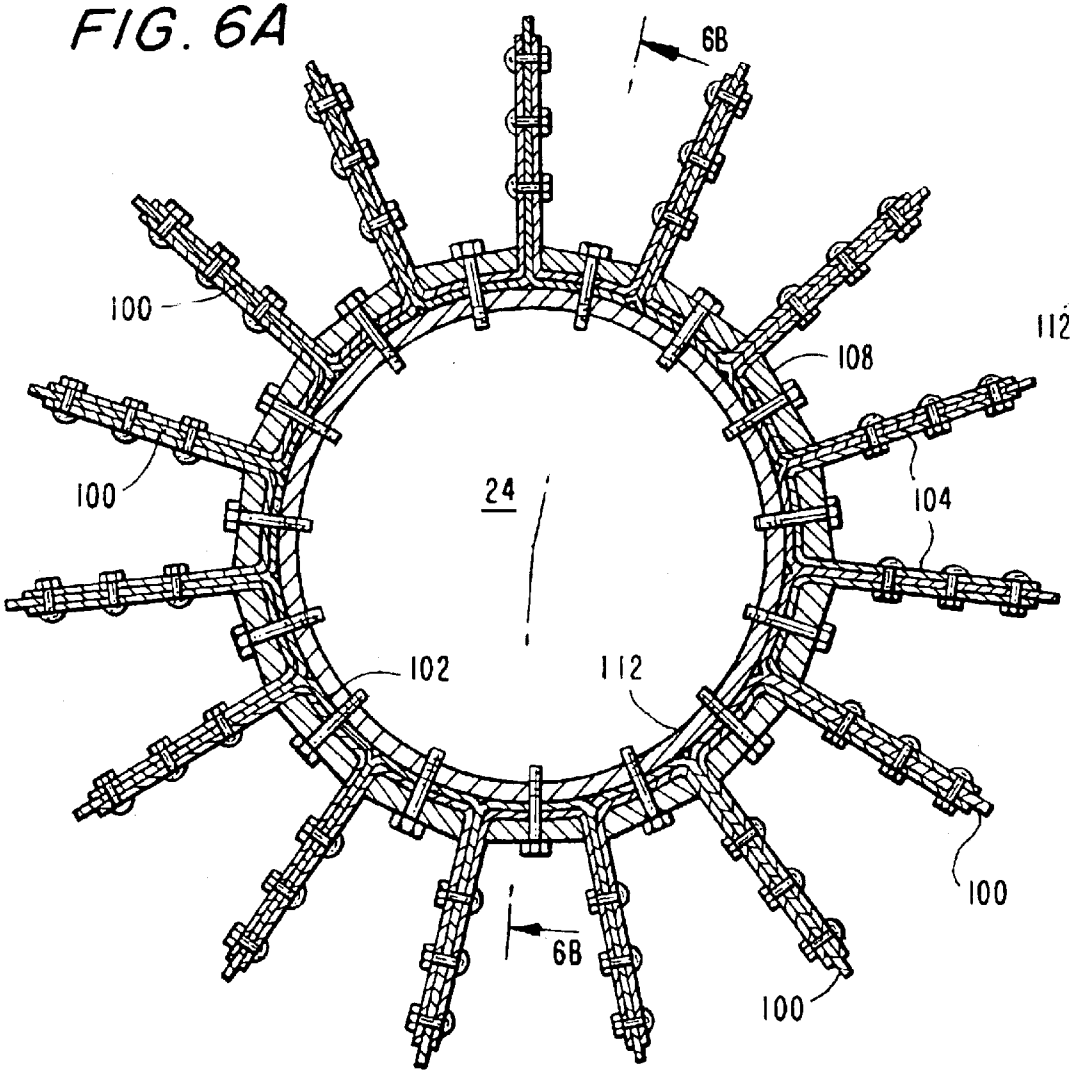

A variation of the immediate aforesaid method is that shown in FIGS. 6A and 6B. FIG. 6A illustrates an axial view of the end (bow, stern, or both) of the FFCV 10. In this regard, the fabric is folded into a plurality of radial folds 100. The folded fabric is sealed on its inner surface prior to folding. The amount the fabric is folded will obviously determine the circumference of the end 102 of the FFCV to which an end fitting 24 is secured. The folds are secured in place by a plurality of U-shaped bands or clamps 104. The adjacent clamps 104 are mechanically affixed together by way of, for example, bolts 106 through the folds of fabric 100. In the center of the U-shaped clamps 104 are respective retaining block 108 which are mechanically fixed (via bolts 110) to a rigid band or mandrel 112 located on the inside of the end of the FFCV defining the circumference of the end opening (bow, stern or both). The end fitting 24 can be affixed to band 112 or may itself comprise the band to which the clamps 104 are secured.

As shown in FIG. 6B, the clamps 104 extend along a relatively short portion of the folds 100 in the longitudinal direction of the FFCV. Accordingly, the folds 100, as they extend rearward, gradually taper until the full circumference of the tube 12 is reached.

Turning now to a further method of creating the end portions of a FFCV 10, as aforesaid, the FFCV may be constructed to form a tubular fabric which is woven, knitted or braided as a single piece. This is highly desirable due to the fact the structure lacks a seam, since seams or joints in the construction of the FFCV can be the source of weakness and can fail.

To create a tapered end portion on an FFCV constructed from a tubular fabric, a solution is to create shape during the weaving, knitting, or braiding process. The tubular weaving industry has developed looms capable of weaving very large tubular structures. For example, the industry has looms that measure 31 meters in width. These looms can be used to create tubular structures having a circumference of up to 124 meters using double endless weaving techniques.

While the existing tubular knitting industry does not have knitting machines that are comparable in size to the large looms of the tubular weaving industry, it is possible that such large equipment could be built to construct large tubular knit structures. With such equipment, one could create taper by gradually dropping knitting needles during the knitting of the structure. This method of creating taper is well known to those skilled in knitting albeit on a smaller scale.

The existing tubular braiding industry also presently does not have braiding equipment comparable in size to the large looms of the tubular weaving industry. However, such large equipment could be built to construct large tubular braided structures. With such equipment, one could create taper by adjusting the speed of the takeup relative to the speed of the yarn that is being braided. This approach would likely be used in a triaxial braiding approach where some of the yarns are oriented in the axial direction of the FFCV. This method of creating taper is well known in the braiding industry, but again on a smaller scale.

In the tubular weaving process, taper can be created by removing or eliminating warp yarns at the far edges of the loom in a sequential fashion as the fabric is woven. The warp yarns that are removed are tied off into the main structure. The result is a woven, tapered, tubular structure. This method of creating taper is well known to those skilled in the tubular weaving art.

It may also be possible to create taper in a tubular weaving process by using a variable pitch reed that draws in the warp yarns as a tube is woven. The method would allow all of the warp yarns to be retained in the weaving process versus dropping out yarns as discussed above.

In the knitting and weaving methods described above, there are limitations on the number of yarns per unit width of fabric that can be made available to carry towing loads. The result can be that the yarn loads are higher than desirable. Such high yarn loads may have a negative impact on the durability of the finished FFCV.

The processes are amenable to dropping yarns to create taper as one goes from a large diameter to a smaller diameter. There is no known method to increase the number of yarns (reverse these processes) to create taper in the opposite direction, i.e. going from a smaller diameter to a larger diameter. While this limitation exists, it is still possible to create taper at one end of the FFCV. This can also be used to create individual tapered ends that can be attached to tube 12. For example, two tapered end portions could be woven and then attached to tube 12. Various methods of attachment could be used. The methods could include sewing, gluing, thermal bonding, or mechanical fastening (or some combination of these). Different textile processes might also be used to create the tube. For example, the tapered end portion may be made using braiding technology. The end portion might be joined to a woven tube 12 which, in turn, might be joined to a knitted tapered end portion. The result would then be a FFCV that would have the desired taper at the bow and stern.

Turning now to FIGS. 7A through 7E, there is shown a further method for forming the end of the tube 12 of an FFCV 10. As shown in FIG. 7A, after the tube 12 is formed at its end or ends 14 and 16 (bow, stern or both), the fabric is pierced creating openings 120 about its circumference. A drawing line 122 (rope, cable, etc.) is then passed through the openings 120 as a drawing in mechanism. A mandrel 124 is placed in the open end of the tube 12 with the drawing line 122 tightened, gathering the fabric about the mandrel 124 (FIG. 7B). A rigid ring 126 (metal, composite, etc.) is then slid rearwardly over the gathered fabric (FIG. 7C). The mandrel 124 may then be removed if so desired and the fabric forward of ring 126 is then folded rearward over ring 126 and may be secured thereto with appropriate sealing being provided therebetween (FIG. 7D). Of course, rather than sliding the ring 126 over the fabric, it could be slid in the opening with the fabric being folded radially inward and secured. In such a situation, the mandrel essentially becomes the ring. An end cap or fitting 24 may then be mechanically secured (e.g. bolted through the fabric) to ring 126 with appropriate sealing therebetween being provided (FIG. 7E). Note that the securing of the end fitting 24 to the ring 126 may in and of itself be sufficient for securing the fabric to ring 126.

Once the FFCV structure has been created, by any of the aforesaid methods, it would be coated (as is necessary) to create an impermeable FFCV. Also, as aforesaid, appropriate end fittings or connectors would be attached having openings for filling and emptying, attachment mechanisms for tow rope and other desired features.

Although preferred embodiments have been disclosed and described in detail herein, their scope should not be limited thereby rather their scope should be determined by that of the appended claims.

We claim:

1. A flexible fluid containment vessel for the transportation and/or containment of cargo comprising a fluid or fluidisable material, said vessel comprising:

an elongated flexible tubular structure comprised of fabric having a first circumference;

means for rendering said tubular structure impervious;

said tubular structure having a front end and a rear end;

means for sealing said front end and said rear end;

means for filling and emptying said vessel of cargo;

wherein at least one of said front end or rear end comprises a plurality of folds or pleats of the fabric of the tubular structure with said pleats or folds having ends which are sealed, a clamping means positioned about said pleats or folds maintaining said pleats or folds in a fixed position, said pleat or fold ends defining a second circumference which is less than that of the first circumference, said pleats or folds extending over a portion of said tubular structure and gradually increasing in size from a point on the tubular structure to said pleat or fold ends so as to create a conical or tapered end and wherein said pleats or folds are folded in a clockwise direction, counterclockwise direction or a combination thereof or folded upon themselves in a stacked arrangement about the second circumference.

2. The vessel in accordance with claim 1 which includes a fitting attached to and sealing the ends of said pleats or folds to said fitting.

3. The vessel in accordance with claim 1 wherein the tubular structure has a longitudinal axis and a plurality of pleats or folds are formed at an angle to said longitudinal axis.

4. The vessel in accordance with claim 1 wherein said front end and said rear end are so formed.

5. A flexible fluid containment vessel for the transportation and/or containment of cargo comprising a fluid or fluidisable material, said vessel comprising:

an elongated flexible tubular structure comprised of fabric having a first circumference and a longitudinal axis;

means for rendering said tubular structure impervious;

said tubular structure having a front end and a rear end;

means for sealing said front end and said rear end;

means for filling and emptying said vessel of cargo;

wherein said tubular structure comprises a plurality of folds or pleats of the fabric extending from the front end to the rear end which are substantially parallel to the longitudinal axis, said pleats or folds having ends which are sealed and means fixing said pleat or fold ends in position whereupon filling said tubular structure with cargo causes said pleats or folds to expand with, however, said pleat or fold ends remaining fixed and wherein said pleats or folds are folded in a clockwise direction, counterclockwise direction or a combination thereof or folded upon themselves in a stacked arrangement.

6. The vessel in accordance with claim 5 which includes a fitting attached to and sealing the ends of the pleats to said fitting.

7. A flexible fluid containment vessel for the transportation and/or containment of cargo comprising a fluid or fluidisable material, said vessel comprising:

an elongated flexible tubular structure comprised of fabric having a first circumference and a longitudinal axis;

means for rendering said tubular structure impervious;

said tubular structure having a front end and a rear end;

means for sealing said front end and said rear end;

means for filling and emptying said vessel of cargo;

wherein at least one of said front end or rear end comprises a portion of the fabric gathered from the tubular structure along a portion of the longitudinal axis extending from one point thereon to said front end or rear end defining an end portion, said fabric being progressively gathered from said point to said end portion, said gathered fabric having an internal surface and an external surface with said internal surface being sealed, said gathered fabric being mechanically fixed in place at said end portion, said end portion defining a second circumference which is less than the first circumference and said end portion so formed is conical or tapered in shape and wherein said gathered fabric is gathered in a manner comprising folding onto itself in a spiral manner, folding it back and forth onto itself in an oscillating manner or a combination of both.

8. A vessel in accordance with claim 7 which includes a fitting attached to and sealing said end portion.

9. A vessel in accordance with claim 7 which includes a plurality of portions of the gathered fabric positioned at a spaced distance from each other.

10. A vessel in accordance with claim 9 wherein said plurality of portions of the gathered fabrics are equidistant from each other about said end portion.

11. A vessel in accordance with claim 7 which includes a fold facilitator means which facilitates folding of the gathered fabric.

12. A vessel in accordance with claim 9 which includes a plurality of fold facilitator means for respective portions of the gathered fabric.

13. A vessel in accordance with claim 7 wherein said gathered fabric is mechanically fixed in place by a clamp positioned about said end portion.

14. A vessel in accordance with claim 1 wherein said front end and said rear end are so formed.

15. A flexible fluid containment vessel for the transportation and/or containment of cargo comprising a fluid or fluidisable material, said vessel comprising:

an elongated flexible tubular structure comprised of fabric having a first circumference and a longitudinal axis;

means for rendering said tubular structure impervious;

said tubular structure having a front end and a rear end;

means for sealing said front end and said rear end;

means for filling and emptying said vessel of cargo;

wherein at least one of said front end or rear end comprises a plurality of radially extending folds or teeth of the fabric of the tubular structure with said folds having ends, means for fixing said fold ends in position, said fold ends defining a second circumference which is less than that of the first circumference, said folds extending over a portion of said tubular structure and gradually increasing in depth from a point on the tubular structure to said fold ends so as to create a conical or tapered end wherein said means for fixing said folds in position includes an end closure device located at said end, and wherein said folds have an internal surface and an external surface and said end closure devices includes a first portion on the external surface and a second portion on the internal surface with said first and second portions mechanically coupled together with said fold positioned therebetween.

16. The vessel in accordance with claim 15 which includes a plurality of end closure devices positioned about said fold ends and define said second circumference.

17. The vessel in accordance with claim 16 which includes a fitting attached to said end closure devices.

18. The vessel in accordance with claim 15 wherein said front end and rear end are so formed.

19. A flexible fluid containment vessel for the transportation and/or containment of cargo comprising a fluid or fluidisable material, said vessel comprising:

an elongated flexible tubular structure comprised of fabric having a first circumference;

means for rendering said tubular structure impervious;

said tubular structure having a front end and a rear end;

means for sealing said front end and said rear end;

means for filling and emptying said vessel of cargo;

wherein at least one of said front end or rear end comprises a plurality of radially extending folds of the fabric of the tubular structure with said folds having ends, means for fixing said fold ends in position, said fold ends being in a star like configuration with a center of the star defining a second circumference which is less than that of the first circumference, said folds extending over a portion of said tubular structure and gradually increasing in depth from a point on the tubular structure to said fold ends so as to create a conical or tapered end and wherein said means for fixing said fold ends in position includes at least one end closure device located at said front end or rear end and wherein said folds have an internal surface and an external surface and said end closure device includes a first portion on the external surface and a second portion on the internal surface with said first and second portions mechanically coupled together with said folds positioned therebetween.

20. The vessel in accordance with claim 19 which includes a plurality of end closure devices positioned between said fold ends and being mechanically coupled together with said folds positioned therebetween.

21. The vessel in accordance with claim 20 which includes a fitting attached to said plurality of end closure devices.

22. The vessel in accordance with claim 19 wherein said front end and rear end are so formed.

23. A flexible fluid containment vessel for the transportation and/or containment of cargo comprising a fluid or fluidisable material, said vessel comprising:

an elongated flexible tubular structure comprised of fabric having a first circumference;

means for rendering said tubular structure impervious;

said tubular structure having a front end and a rear end;

means for sealing said front end and said rear end;

means for filling and emptying said vessel of cargo;

wherein at least one of said front end or rear end comprises the fabric gathered so as to define a second circumference which is less than that of the first circumference at one of said ends and ring means maintaining said gathered fabric in a fixed position and wherein said gathered fabric is gathered in a manner comprising folding onto itself in a spiral manner, folding it back and forth onto itself in an oscillating manner or a combination of both.

24. The vessel in accordance with claim 23 which includes an end fitting mechanically attached to said ring means.

25. The vessel in accordance with claim 23 wherein said gathered fabric is folded upon said ring means and secured in place.

26. The vessel in accordance with claim 23 wherein said front end and rear end is so formed.

27. A method of creating a front end or rear end of a flexible fluid containment vessel for the transportation and/or containment of cargo comprising a fluid or fluidisable material comprising the steps of:

providing an elongated flexible tubular structure comprised of fabric having a first circumference and a front end and a rear end, gathering the fabric at at least one of said front end or rear end about a mandrel so as to define a second circumference which is less than that of the first circumference;

positioning a ring about said gathered fabric; and folding said gathered fabric in a manner comprising folding onto itself in a spiral manner, folding it back and forth onto itself in an oscillating manner or a combination of both upon said ring and securing it thereto.

28. The method as described in claim 27 which includes the further step of securing an end fitting to said ring.

29. The method as described in claim 27 which includes the further step of forming said front end and said rear end in such a manner.

* * * * *